United States Patent [19]

Daenen

[11] 4,234,097

[45] Nov. 18, 1980

[54] SERVING PLATE SET OR THE LIKE

[75] Inventor: Robert H. C. M. Daenen, Hekelgem, Belgium

[73] Assignee: Dart Industries Inc., Los Angeles, Calif.

[21] Appl. No.: 102,060

[22] Filed: Dec. 10, 1979

Related U.S. Application Data

[63] Continuation of Ser. No. 733,563, Oct. 18, 1976, abandoned.

[51] Int. Cl.[3] ..... B65D 21/02; B65D 1/26; B65D 43/08

[52] U.S. Cl. ..... 220/4 D; 150/0.5; 206/501; 206/821; 220/4 B; 220/23.86; 229/2.5 R

[58] Field of Search ..... 220/4 B, 4 C, 4 D, 4 E, 220/23.6, 23.83, 23.86, 20; 206/501, 821; 150/0.5; 224/2.5

[56] References Cited

U.S. PATENT DOCUMENTS

| | | | |
|---|---|---|---|
| 1,542,115 | 6/1925 | Weis | 220/4 D |
| 1,908,806 | 5/1935 | Allen | 220/4 D |
| 2,217,644 | 8/1940 | Connor | 220/4 D |
| 3,143,205 | 8/1964 | Ruderian | 220/23.83 |
| 3,360,153 | 12/1967 | Wheaton | 220/4 B |
| 3,412,888 | 11/1968 | Andrews | 220/4 B |

*Primary Examiner*—George E. Lowrance
*Attorney, Agent, or Firm*—Leigh B. Taylor

[57] ABSTRACT

A serving plate set having two similar receptacles which in one form is separated by a sealing member that segregates the receptacle contents, such member also being of a plate-like configuration and which in another form employs the two receptacles to create a closured container.

1 Claim, 6 Drawing Figures

SERVING PLATE SET OR THE LIKE

This is a continuation of Ser. No. 733,563, filed Oct. 18, 1976, now abandoned.

This invention relates to a serving plate set, the elements of which are adapted for interengagement so that in at least two assembled forms it also functions as a closured container, one of which further provides for separate compartmental food storage sections. More particularly, therefore, the serving plate set functions in a dual capacity whereby the food contained therein can be appropriately consumed from the container elements themselves. The plate set construction further contemplates the use of two similarly shaped and sized receptacles, each separately sealable by a sealing member positioned between them so that the contents of each receptacle is segregated from the other. The concept also incorporates as a feature thereof the appropriate shaping of the center wall area of the sealing member such that it can also be used as a plate should it be so desired to do so.

Prior art containers have, of course, incorporated receptacle and closure elements that are constructed in a fashion to permit their usage as plate members. However, such designs and constructions have not contemplated the employment of a common seal which could be used to simultaneously be used between to seal separate receptacles. Accordingly, such do not provide suitable means for the storage of different consumables in the seal and the receptacle elements.

The instant construction, therefore, affords the user of a device which is multifaced in nature and thus will minimize his need for a variety of different serving and storage dishes, containers and plates. Similarly, either of the receptacle members may be used alone with the sealing member until additional storage capacity is required. This single receptacle usage, of course, minimizes the space requirements used in such food storage. Likewise, the receptacles of the set may be employed without the common seal to produce a container of increased capacity.

These and other objects and advantages of the invention will become more apparent from the following detailed description of a preferred form of the invention when taken in conjunction with the drawings wherein.

Figure 1:
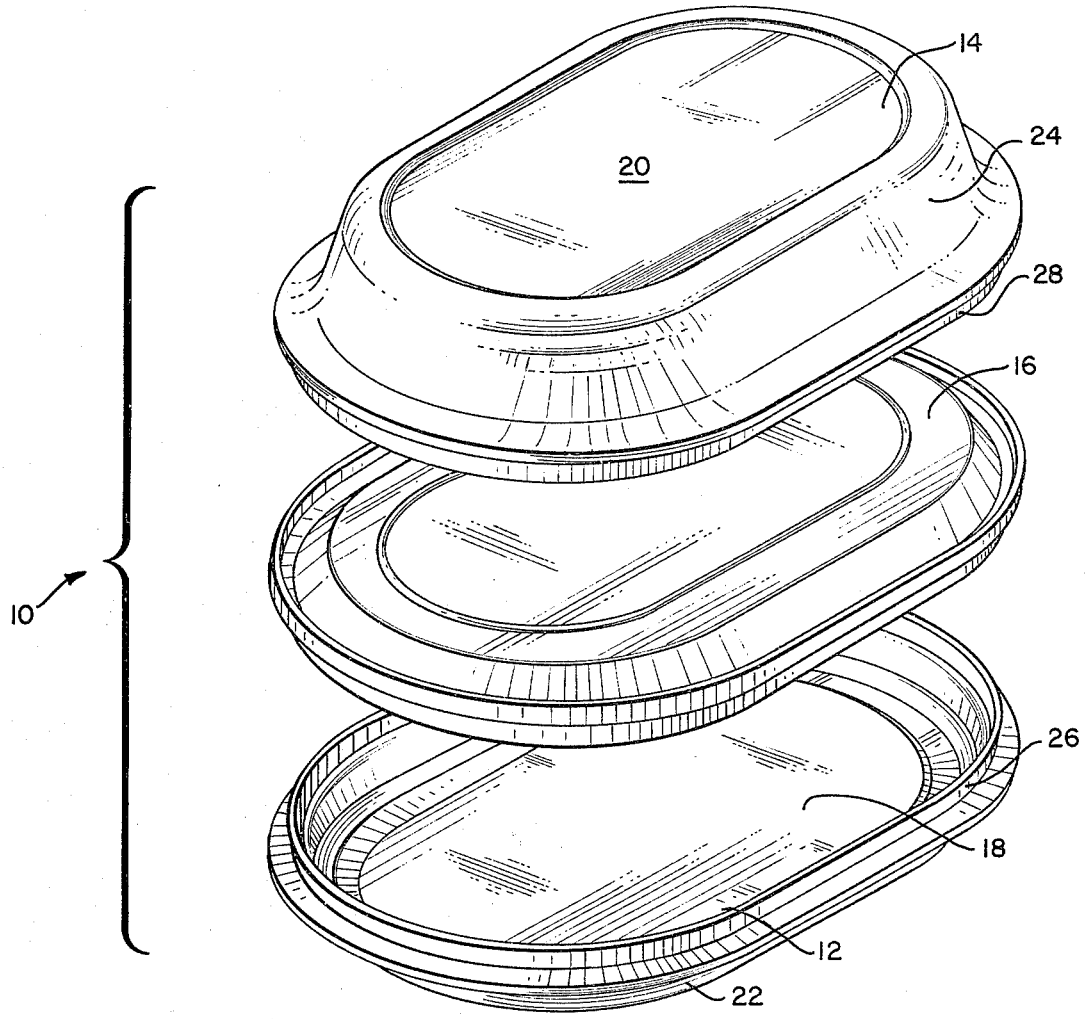
FIG. 1 is an exploded perspective view of one form of the serving plate set of the present invention.
Figure 2:
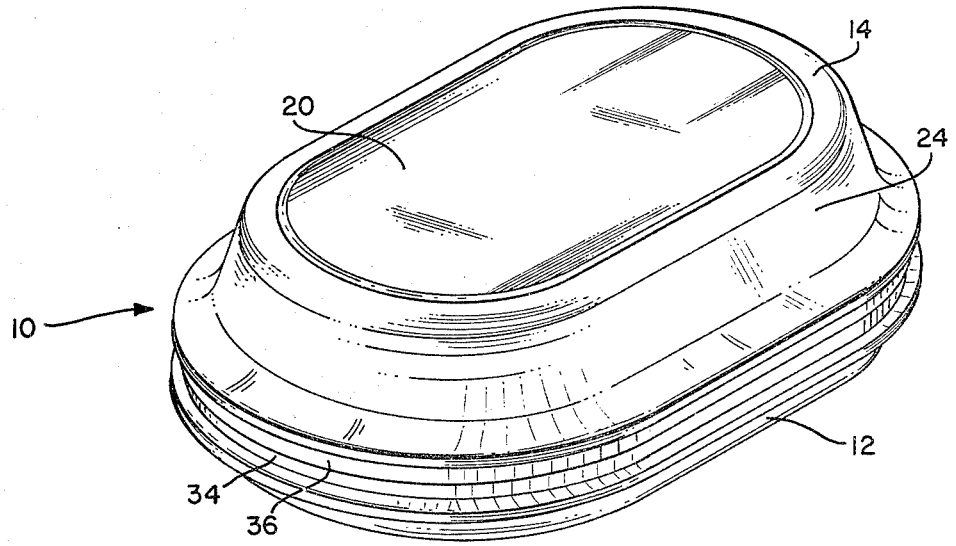
FIG. 2 is a top perspective view of the invention of FIG. 1 shown in assembled form.
Figure 3:
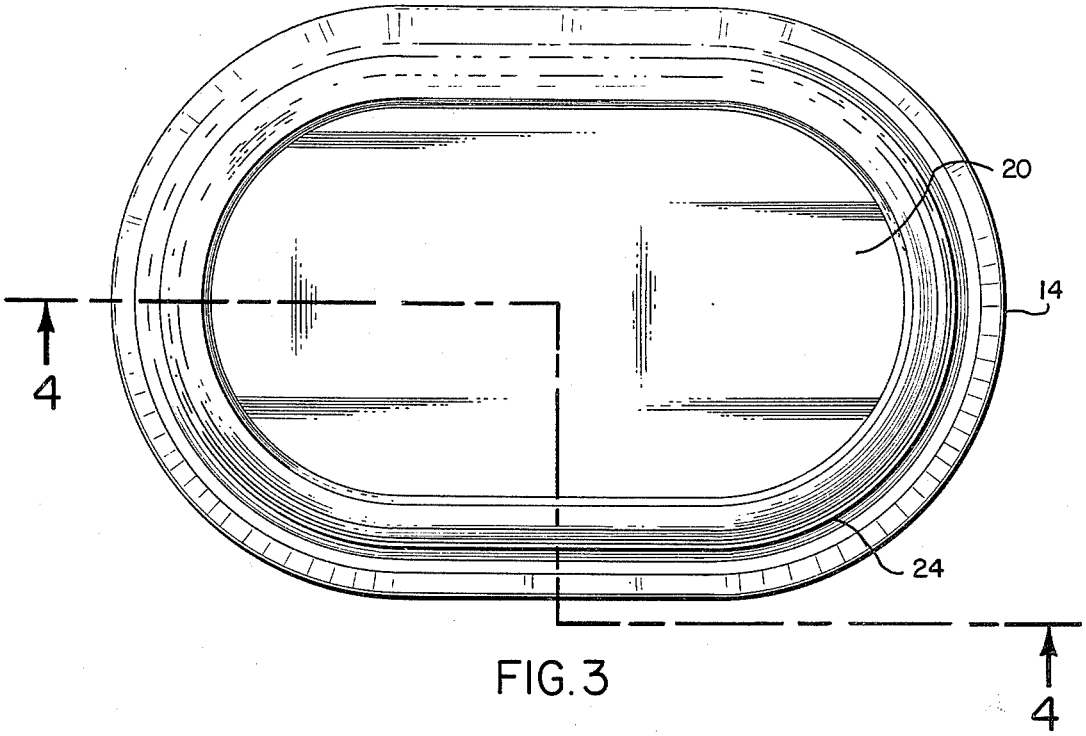
FIG. 3 is a top plan view thereof.

The serving plate set of this invention generally indicated in FIG. 1 by reference numeral 10 includes a first receptacle or plate 12, a second receptacle or plate 14, and a common seal member 16 which in assembled form (FIG. 2) produce a segmented container having two separate and distinct storage compartment sections. While each of these elements 12, 14 and 16 are illustrated as being semi-ovate in shape, it should be understood that such may take any other suitable shape depending upon the contemplated end usage of the device.

Each of the basic plates or receptacles 12 and 14 are of a similar structural arrangement and respectively incorporate bottom walls 18 and 20, and upstanding peripheral sidewalls 22 and 24, which teriminate in first and second upper edges 26 an 28.

Figure 4:
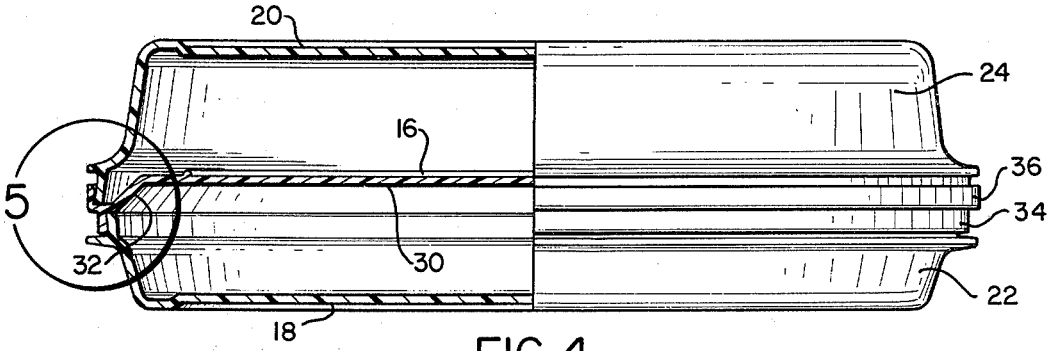
FIG. 4 is a side elevational view of the assembled serving plate set with a partial cross-sectional showing taken along line 4—4 of FIG. 3.
Figure 5:
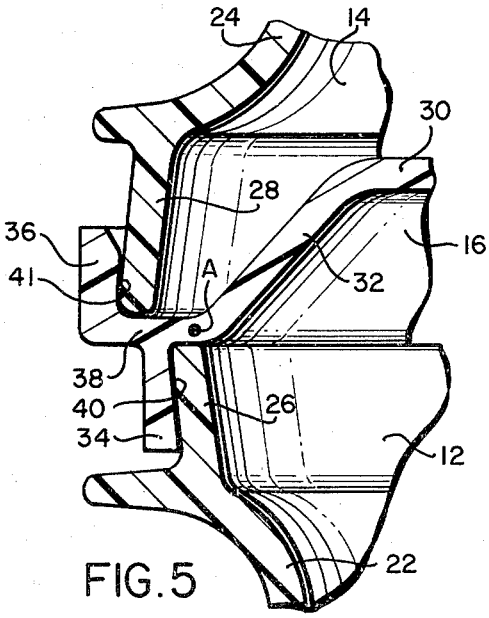
FIG. 5 is an enlarged cross-sectional view taken of the circled segment 5 of FIG. 4; and, FIG. 6 is an enlarged cross-sectional area similar to the circled segment 5 of FIG. 4 except that the common seal therebetween has been removed.

Sealing member 16 is formed by a dish shaped central wall 30, 32 and incorporates a peripherally extending flange 38 which is integral therewith and from which depend a downwardly extending rim 34 and an upstanding peripheral rim 36. As is apparent in FIGS. 4 and 5, the subject rims 34, 36 are slightly offset with respect to one another, and such relationship produces very desirable results which are more fully discussed hereinafter. Likewise, note that rims 34, 36 incorporate inside faces 40, 42 which are slightly slanted and are adapted to firmly engage against the exterior surfaces of upper edges 26 and 28 in a liquid sealing fashion.

The respective serving plates 12 and 14 also vary slightly in their respective depths and the upper edge 28 of plate 14 is positioned and flared outwardly such that the terminus of its outermost extent is of a greater peripheral extent than that of the serving plate 12. This produces several desirable effects, especially in the sealing of each of the respective receptacles by sealing member 16. Note in particular (FIG. 5) that each of the serving plates are sealed along the outer surfaces of their upper edges 26 and 28. Accordingly, because the peripheral extents of these upper edges are of a different magnitude, the mentioned upper edges 26 and 28 are slightly offset. Accordingly, when sealing member 16 is in its assembled position, the sealing pressure applied by each of those respective edges 26, 28 is translated through that sealing member in bending moment fashion to produce an even better sealing effect on each of the respective outer surfaces.

Such bending moment forces are, of course, improved because of the extent of the lever arm provided within flange 38. Accordingly, the pressure applied between edge 26 and rim 34 tends to produce an upward movement of flange 38 in a pivotal fashion around point A. This, in turn, tends to move the rim 36 inwardly and into a better mating engagement with the outer surface of upper edge 28. Likewise, the sealing pressure developed between upper edge 28 and rim 36 tends to produce a similar action which deflects the rim 34 into even better sealing engagement with upper edge 26 of serving plate 12.

Preferably, the plates or receptacles 12,14 are formed from rigid plastic materials such as high density polyethylene or polypropelene, while the separating seal member 16 is preferably formed of low density polyethylene materials. These particular material combinations, as will be appreciated, improve the sealing effect obtained between the respective members and further assures that a liquid tight seal is maintained therebetween.

Figure 6:
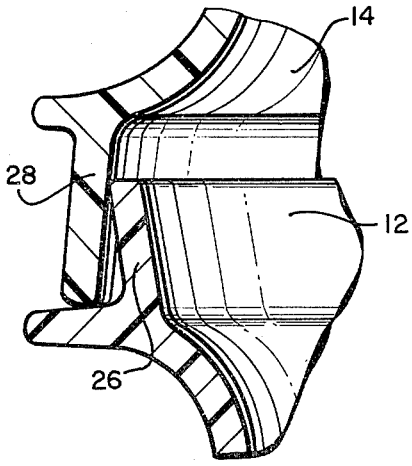

Furthermore, it should be appreciated that the design and construction of the instant serving plate set (FIG. 6) enables the user to selectively employ only the plates 12 and 14 in the storage of foodstuffs. This is accomplished again by employing the difference in peripheral extents of upper edges 26 and 28. Accordingly, the upper edge 28 can be slipped over the upper edge 26 in a fashion such that the two serving plates will be securely engaged one with respect to the other in a closuring fashion. Thus, should it be desired not to use the sealing member 16, these two plates alone can be employed to effectively containerize appropriate foodstuff products. Likewise note that depending upon the quantity of consumables to be stored, either of the plates 12, 14 may be employed as the principal receptacle in this interrelated relationship.

While a preferred form of the invention has been described and disclosed above, it is to be understood that such changes and alterations as would occur to those skilled in the art are to be considered within the purview of this invention and to fall within the scope of the appended claims.

I claim:

1. A plate set comprising a first plate having a bottom wall and upstanding peripheral walls terminating at an upper edge, a seal plate having a top wall and integral downwardly extending peripheral walls terminating at a lower edge, a flange integral with and extending outwardly from said lower edge, a first rim wall integral with and extending downwardly from said flange, and a second rim wall integral with and extending upwardly from said flange, and slightly offset from said first rim wall, said upper edge having an outer diameter greater than an inner diameter of an inner face of said first rim wall, the upper edge of the first plate being engaged in a liquid tight seal against the inner face of said first rim wall, said first plate and said seal plate being separable from each other and adapted to container consumables when the first plate and the seal plate are sealed together and a second plate having a bottom wall and upstanding peripheral walls terminating at a second upper edge which edge is in engagement with an inner face of said second rim said engaged upper edge and inner face providing a bending moment force for providing a liquid seal between the inner face of said second upper rim wall and said second upper edge.

* * * * *